United States Patent [19]

DuPree

[11] Patent Number: 4,958,447

[45] Date of Patent: Sep. 25, 1990

[54] ATHLETIC SHOE WITH BREAK-AWAY HIGH TOP

[76] Inventor: Tony L. DuPree, 2413 Skyline Dr., Box 7, Garner, N.C. 27529

[21] Appl. No.: 370,762

[22] Filed: Jun. 23, 1989

[51] Int. Cl.[5] ..... A43B 3/24

[52] U.S. Cl. ..... 36/101; 36/100; 36/114

[58] Field of Search ..... 36/1.5, 100, 101, 114

[56] References Cited

U.S. PATENT DOCUMENTS

| | | | |
|---|---|---|---|
| D. 280,567 | 9/1985 | Ji | 36/101 X |
| D. 295,576 | 5/1988 | Selbiger | D2/310 X |
| D. 298,082 | 10/1988 | Selbiger et al. | D2/310 X |
| D. 302,898 | 8/1989 | Greenberg | D2/310 X |
| 1,572,313 | 2/1926 | Sarar | D2/310 X |
| 4,366,634 | 1/1983 | Giese et al. | 36/114 |

FOREIGN PATENT DOCUMENTS

| | | | |
|---|---|---|---|
| 367368 | 1/1939 | Italy | 36/1.5 |

OTHER PUBLICATIONS

Footwear News, Jan. 24, 1986, vol. 42, No. 5, p. 39.

*Primary Examiner*—Paul T. Sewell
*Assistant Examiner*—Andrew D. Meyers
*Attorney, Agent, or Firm*—Rhodes, Coats & Bennett

[57] ABSTRACT

The present invention is an athletic shoe with a break-way high top. The shoe comprises an upper which is secured along its lower extent to a sole portion. The upper includes a main body section extending about the heel and sides of the foot and a toe section extending around and over the toe area of the foot. The main body section of the upper defines an ankle opening, the margins of which extend below the ankle bone on the lateral and medial side of the wearer's foot. A break-away high top including an ankle cuff is removably secured to the main body section of the upper and is adapted to wrap around the wearers ankle. Attaching the high top to the upper converts the athletic shoe from a low top athletic shoe to a high top athletic shoe.

5 Claims, 4 Drawing Sheets

ATHLETIC SHOE WITH BREAK-AWAY HIGH TOP

FIELD OF THE INVENTION

The subject matter of the present invention relates generally to athletic shoes and particularly to athletic shoes having a break-away high top for converting a low top athletic shoe to a high top athletic shoe.

BACKGROUND OF THE INVENTION

Athletic shoes for use in various athletic activities, such as running, basketball, soccer, and football have been constructed in basically two styles. Where the athletic activity for which the shoe is used is primarily running, tennis, or soccer, so called low cut athletic shoes are generally preferred because they do not impinge on the movement of the ankle. However, where the primary athletic activity is basketball, or some other activity where increased ankle support is necessary, high top athletic shoes are generally preferred. Presently, persons engaged in various athletic activities are forced to choose between low top athletic shoes or high top athletic shoes, or to purchase two pairs of shoes.

Convertible shoes are not entirely unknown. For example, the patent for Crook, U.S. Pat. No. 854,274 discloses a low shoe having a removable upper for converting the shoe into a high shoe. A plurality of fastening devices extend along a line around the foot receiving opening for securing the break-away upper. A cover strip is engagable with the fastening devices when the upper is removed to conceal the fastening devices. The break-away high top described in Crook, however, is not suited for strenuous athletic activities.

SUMMARY AND OBJECTS OF THE INVENTION

The present invention overcomes some of the disadvantages of the prior art by providing an athletic shoe which is convertible from a low top shoe to a high top shoe. The shoe of the present invention comprises an upper which is secured along its lower extent to a sole portion. The upper includes a main body section extending about the heel and sides of the foot and the toe section extending around the toe area of the foot. The upper defines an ankle opening through which the foot is inserted and a tongue opening. In the preferred embodiment, a pair of lace hole reinforcing members extend along opposite sides of the tongue opening.

The break-away high top is also provided for converting the normal low top shoe to a high top shoe. The break-away high top includes an ankle cuff which wraps around the ankle of the wearer. A pair of connecting straps which extend forwardly from the ankle cuff can be secured by suitable fastening means to the upper terminal ends of the lace hole reinforcing members. Additionally, the lower edge of the cuff overlaps the heel portion where it is also secured by suitable fastening means. Tightening straps are also provided for securing the cuff about the ankle.

From the foregoing, it is apparent that a primary object of the present invention is to provide an athletic shoe with a break-away high top for converting a conventional low top athletic shoe to a high shoe.

Another object of the present invention is to provide an improved athletic shoe in which additional ankle support is available to prevent over inversion of the foot during strenuous athletic activity, but in which the increased ankle support can be removed when it is not needed so as not to hamper the athlete's abilities.

Another object of the present invention is to provide a convertible athletic shoe which is comfortable for the wearer.

Other objects and advantages of the present invention will become apparent and obvious from a study of the following description and the accompanying drawings which are merely illustrative of such invention.

BRIEF DESCRIPTION OF THE INVENTION

DETAILED DESCRIPTION OF THE INVENTION

Figure 1:
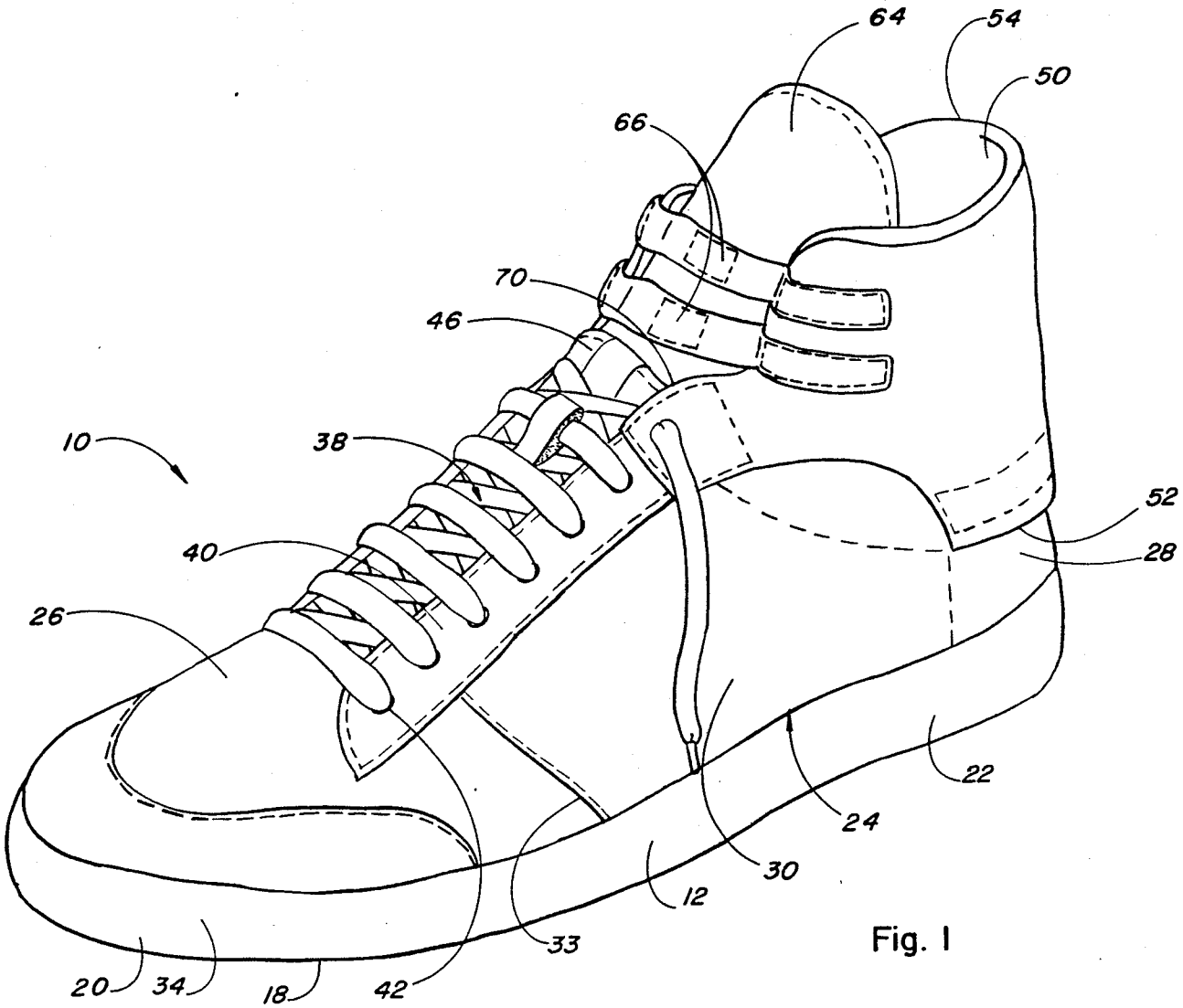
FIG. 1 is a perspective view of the convertible athletic of the present invention.
Figure 2:
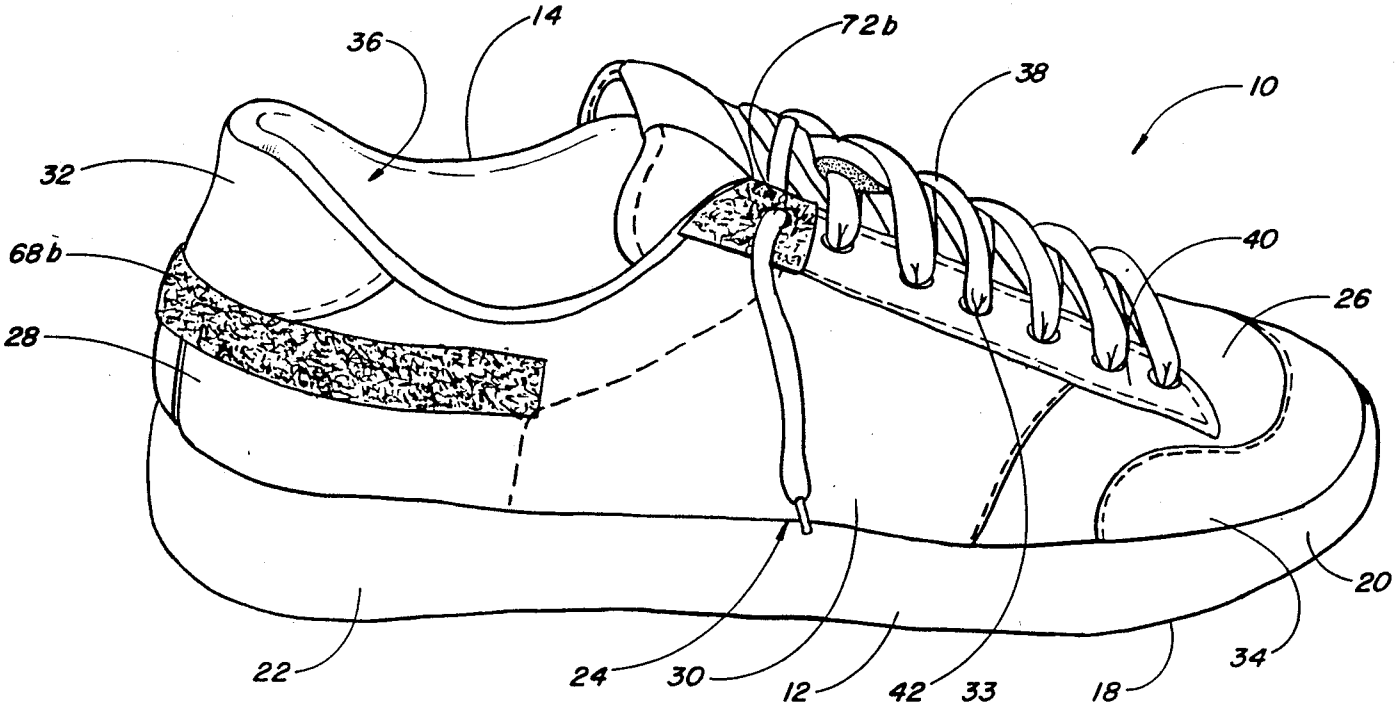
FIG. 2 is a perspective view of the convertible athletic without the break-away high top.

FIG. 1 shows a perspective view of the convertible athletic shoe in a preferred embodiment of the invention. The athletic shoe is indicated generally by the numeral 10. The athletic shoe includes a sole portion 12, an upper 14 attached to the sole portion 12, and a break-away high top 16.

The sole portion 12 includes an outer sole 18 and a midsole 20. The outer sole 18 is made preferably of a resilient natural or synthetic rubber. Depending on the intended use of the shoe, the outer sole 18 may have a plurality of treads or cleats molded into its lower surface for better traction. The midsole 20, which may be a single layer or multiple layers, is preferably made of a resilient cushioning material which is less hard than the outer sole 18, such an EVA sponge. The midsole 20, preferably includes a thickened heel lift 22.

The upper 14 is joined along its lower extent to the sole portion 12. The upper includes a main body section 24 and a toe section 26, which are made preferably of a strong, wear resistant material such as leather or vinyl. Other materials, such as a nylon mesh, which provides high strength and breathability, can also be used. The main body section 24 comprises a heel portion 28 which extends around the heel of the foot and side portions 30 which extend along the lateral and medial sides of the foot. The heel portion 28 of the main body section may include a heel reinforcing member 32, also made of leather, which is stitched to the outer surface of the heel portion 28.

The main body section 24 is joined with the toe section 26 at the lateral and medial sides of the shoe approximately adjacent the ball of the foot as indicated at 33. The toe section 26 may include a toe reinforcing member 34, which is made of leather.

The upper defines an ankle opening 36 through which the foot is inserted and a tongue opening 38. Lace hole reinforcing members 40 extend along both sides of the tongue opening from the ankle opening 36 to the toe section 26. The lace hole reinforcing members 40 include a plurality of lace holes 42. A shoe lace 44 is threaded through the lace holes 42 in a conventional manner and serves to secure the shoe 10 to the foot of the wearer. It is appreciated however that other fastening means may be utilized in connection with the present invention.

Figure 3:
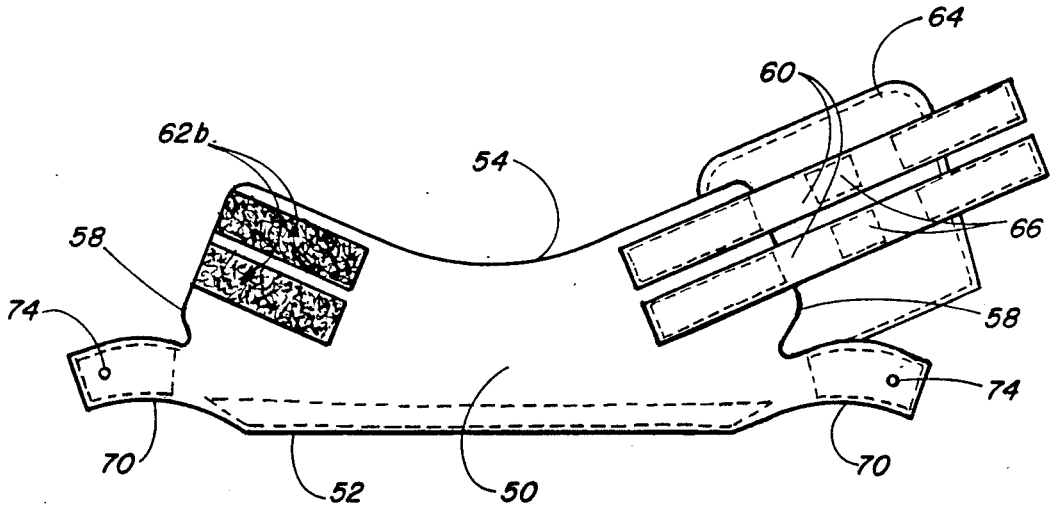
FIG. 3 is an outside view of the break-away high top flattened out.
Figure 4:
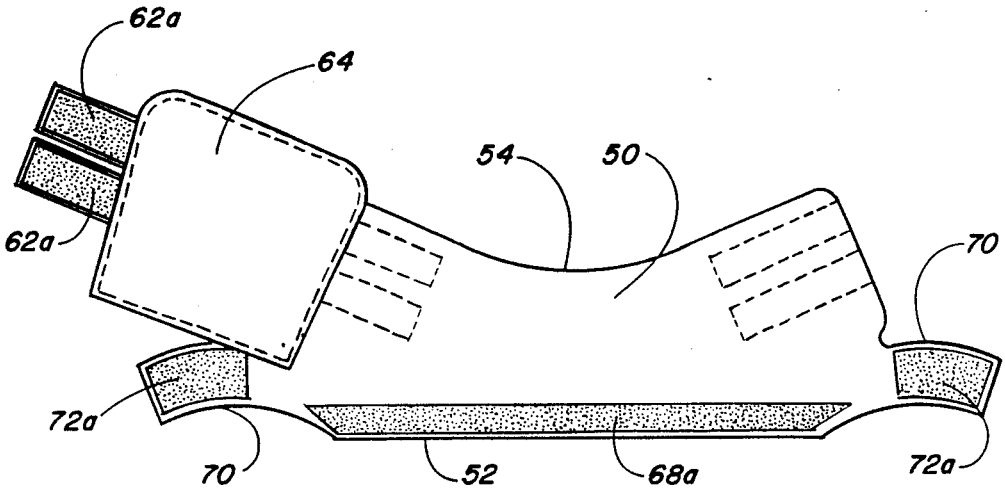
FIG. 4 is an inside view of the break-away high top flattened out.
Figure 5:
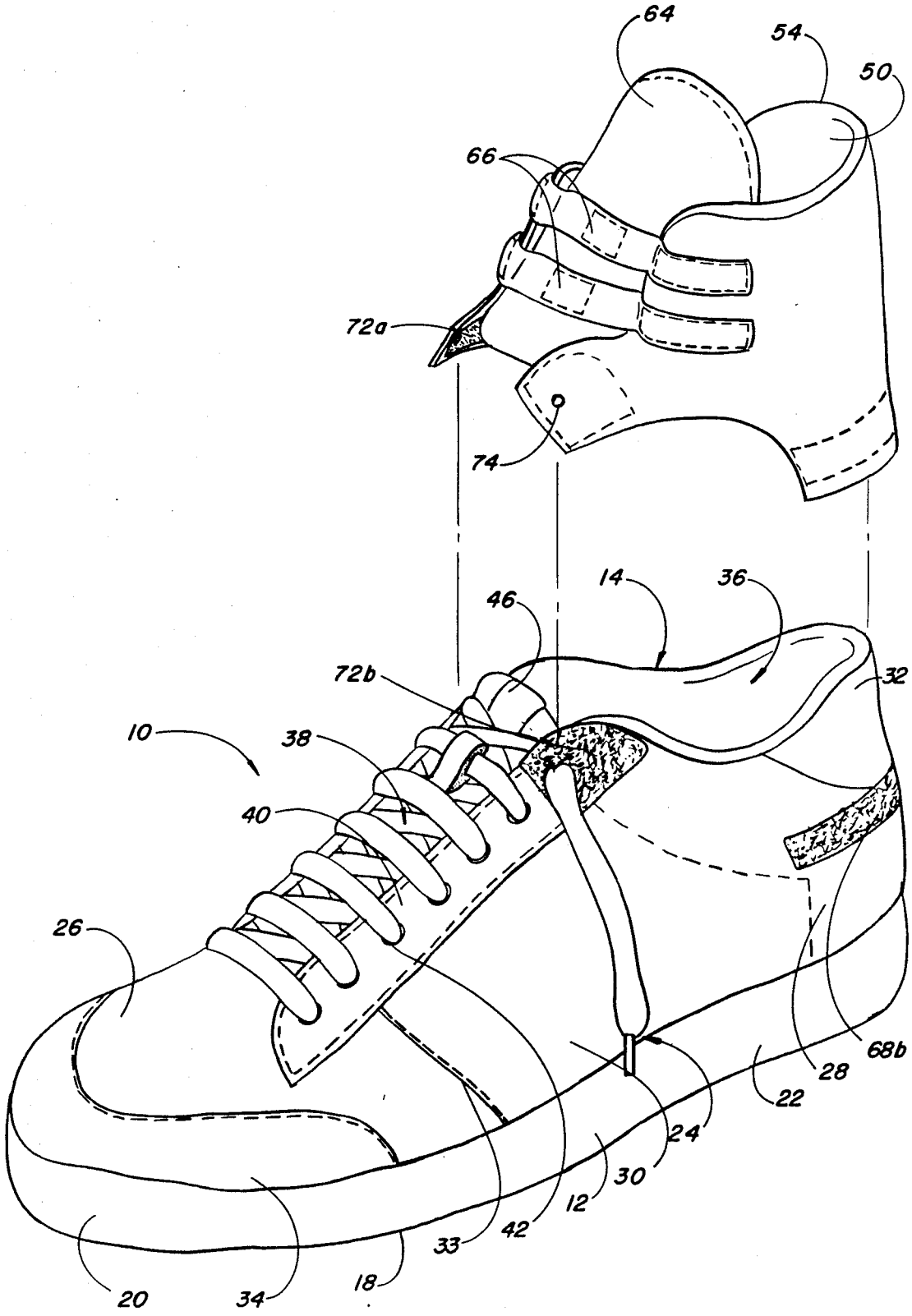
FIG. 5 is a perspective view of the convertible athletic shoe with the high top separated from the upper.

In contrast to a shoe of conventional construction, the shoe 10 of the present invention includes a break-away high top for converting the shoe 10 from a low top shoe to a high top shoe. Referring now to FIGS. 3 and 4, the break-away high top is shown with the high top flattened out. The break-away high top includes an ankle cuff 50 which is adapted to wrap around the ankle of the wearer. The lower edge 52 of the ankle cuff 50 overlaps the upper 14, particularly along the heel portion 28. The upper edge 54 extends above the ankle bone of the wearer's ankle, so as to cover at least a portion of the lower leg.

The forward edges 58 of the ankle cuff 50 define an open space when the cuff is wrapped around the ankle which is essentially a continuation of the tongue opening 38 on the upper 14. A pair of parallel tightening straps 60 are secured along one of the forward edges 58 of the ankle cuff 50, such as by stitching and extended across the open space to the opposite edges of the cuff 50 where the free end attaches to the cuff 50. The fastening means may be a conventional hook and loop type fastener such as sold under the trademark VELCRO. As shown in FIGS. 3 and 4, one component **62*a* of the hook and loop fastener is sewn inside the free end of each tightening strap, while the other component 62*b* is sewn to the outside of the cuff 50 adjacent one forward edge. Because the straps 60 extend across the open space, a padded tongue 64 is attached to the tightening straps 60 such as by stitches 66** to prevent chafing and abrasion of the wearers foot and leg.

The present invention also incorporates a releasable securing means for firmly securing the break-away high top to the upper 14 of the shoe 10. To prevent the high top 16 from separating from the upper 14 during strenuous athletic activity, the present invention utilizes a three-point connecting system, although it is appreciated that additional connecting points may be utilized. In the embodiment shown, the first connection point is at the heel. The remaining two connection points are disposed forward of the ankle opening 36 on opposite sides of the tongue opening 38. Preferably, these two connection points are at the upper terminal end of each lace hole reinforcing member 40.

To implement the three-point connection system, a pair of connecting straps 70 extend forwardly from the forward edges 58 of the ankle cuff and are angularly disposed so as to overlie the upper terminal end of the lace hole reinforcing members 40 when the ankle cuff 50 is wrapped around the wearer's ankle. A first hook and loop type fastening component **72*a* is sewn to the free end of the connecting strap 70 while a corresponding hook and loop fastening component 72*b* is sewn to the upper terminal end of each lace hole reinforcing member 40. Additionally, a lace hole 74 may be formed in the free end of each connecting member which aligns with the uppermost lace hole 42 in the lace hole reinforcing members 40. This expedient assures that the high top 16** cannot be unintentionally dislodged.

The shoe without the break-away high top is used in the same manner as a conventional low top athletic shoe. The shoe 10 is inserted onto the foot of the user and is secured by pulling the laces together to draw the side portions 30 of the main body section 24 together and then tieing the lace. When additional ankle support is needed, the break-away high top 16 can be attached to the upper 14 without removing the shoe 10. The lace 44 is untied and pulled out of the first lace opening 42. The ankle cuff 50 is then wrapped around the ankle so that the lower edge 52 overlaps the heel portion 28 of the upper 14 as shown in FIG. 1. As the cuff 15 is wrapped around the ankle, the hook and loop type fastening component **62*a* on the ankle cuff 50 is meshed with corresponding fastening component 62*b* on the heel portion 28 of the upper 14 as shown in FIG. 1. The free ends of the connecting straps 70 are then secured to the upper terminal end of the lace hole reinforcing members 40 by pressing the hook and loop type fastener component 74*a* on the connecting strap against the corresponding hook and loop fastener component 74*b*. The lace 44 may then be threaded back through the aligned lace hole openings 42 and 74 and retied. The tightening straps 60 are next pulled across the open space between the forward edges 58 of the cuff and secured by pressing the hook and loop type fastening components 62*a* on the free ends of the tightening straps 60 against the corresponding hook and loop type fastening components 62*b* on the ankle cuff 50. Care should be taken to insure that the side edges of the tongue 64 are tucked beneath the forward edges 58 of the cuff 50**. The entire process takes about 30 seconds to one minute for each shoe.

Based on the foregoing, it should be apparent to those skilled in the art that the present invention provides a convenient method for converting a conventional low top athletic shoe to a high top athletic shoe. The high top can be attached whenever increased ankle support is needed and can be removed when it is not needed so that the athletic abilities of the wearer are not hampered. Thus, the shoe of the present invention serves the same function as two prior art shoes.

Additionally, it should be apparent that the three point connection system provides a secure connection between the high top and the upper which prevents separation of the high top from the upper in all but the most unusual circumstances.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A convertible athletic shoe comprising:

(a) a sole portion;

(b) an upper fixed to the sole portion including a heel portion, side portions and a toe portion, wherein the upper defines an ankle opening and a tongue opening and wherein the upper includes a lace border adjacent the tongue opening having a series of lace holes formed therein;

(c) a shoe lace threaded through the lace holes in the upper for securing the shoe to the wearer's foot when the lace is tied;

(d) a detachable high top releasably secured to the upper for converting the shoe from a low top shoe to a high top shoe, the high top including an ankle cuff adapted to wrap around the wearer's ankle, wherein the ankle cuff includes a lower edge portion which overlaps the heel portion of the upper and a pair of connecting straps having at least one lace opening formed therein, wherein the connecting straps extend generally forwardly from the ankle cuff and overlap the lace border of the upper so that at least one lace opening in each connecting strap aligns with at least one lace hole in the upper, and wherein the shoe lace can be threaded through the lace opening in the connecting strap to aid in securing the detachable high top to the upper; and (e) cooperative fastening means including first and second fastener components attached respectively to the heel portion of the upper and the lower edge portion of the ankle cuff for releasable securing the high top to the upper.

2. The convertible athletic shoe according to claim 1 wherein the ankle cuff includes forward edges which are spaced apart when the ankle cuff is wrapped around the wearer's ankle so as to define an open space therebetween, and wherein the high-top further includes a tongue secured to the ankle cuff and adapted to be disposed in the open space between the forward edges of the cuff.

3. The athletic shoe according to claim 1 wherein the detachable high-top further includes means for tightening the ankle cuff about the ankle.

4. The athletic shoe according to claim 3 wherein the tightening means comprises at least one tightening strap having a fixed end secured along one of the forward edges of the ankle cuff, and a free end wherein the tightening strap is adapted to extend across the open space between the forward edges of the ankle cuff and wherein the tightening means further include means for securing the free end of the tightening strap.

5. The athletic shoe according to claim 4 wherein in the means for securing the free end of the tightening strap comprises a cooperative fastening means having first and second fastener components, wherein the first fastener component is attached to the free end of the tightening strap and the second fastener component is attached to the ankle cuff adjacent the opposite forward edge.

* * * * *